US008196592B2

(12) United States Patent
Choi

(10) Patent No.: US 8,196,592 B2
(45) Date of Patent: Jun. 12, 2012

(54) HAIR BRUSH FOR HOT CURLING

(75) Inventor: Jin Ho Choi, Dongducheon-si (KR)

(73) Assignee: Haejeong Min, Aliso Viejo, CA (US)

( * ) Notice: Subject to any disclaimer, the term of this patent is extended or adjusted under 35 U.S.C. 154(b) by 127 days.

(21) Appl. No.: 12/832,969

(22) Filed: Jul. 8, 2010

(65) Prior Publication Data

US 2011/0017226 A1 Jan. 27, 2011

(30) Foreign Application Priority Data

Jul. 13, 2009 (KR) ..... 10-2009-0063436

(51) Int. Cl.
*A45D 6/02* (2006.01)
*A45D 24/16* (2006.01)

(52) U.S. Cl. ..... 132/237; 132/120

(58) Field of Classification Search ..... 132/120, 132/122, 152, 163, 237
See application file for complete search history.

(56) References Cited

U.S. PATENT DOCUMENTS

2003/0070244 A1* 4/2003 McEntyre et al. ..... 15/160
* cited by examiner

*Primary Examiner* — Rachel Steitz
(74) *Attorney, Agent, or Firm* — Cantor Colburn LLP

(57) ABSTRACT

A hair brush for hot curling includes a body, a closing cap, a connection member and a brush part. The body made of ceramic coated aluminum includes holes through which a steel teeth of the brush part protrudes. The closing cap engages with the body formed by assembling segmented portions. The connection member for connecting the segmented portions of the body includes a body part and an insertion groove to which the body is inserted. The brush part includes a handle part and a fastening part, a first end of which is connected to the handle part and a second end is engaged with one end of the assembled body. An iron core is formed by twisting two or more wires, one end of which is securely engaged within the fastening part, a plurality of the steel teeth being formed on the iron core in a circumferential direction thereof.

7 Claims, 7 Drawing Sheets

HAIR BRUSH FOR HOT CURLING

BACKGROUND OF THE INVENTION

1. Field of the Invention

The present invention relates to a hair brush for hot curling, and more particularly to a hair brush for hot curling in which hair tangles and hair damage, which can be caused by static electricity during drying or curling the hair, may be prevented by providing a connection member formed in silicon or carbon positioned in at least one position of a body of the hair brush that is made of aluminum.

2. Description of the Related Art

Generally, a hair brush is a tool designed to brush and style a hair. Compared to a comb that normally consists of a single material, on one side of which a plurality of teeth is aligned in a row, the hair brush is advantageous in that a plurality of teeth is fixed to a pad thereof so as to efficiently perform hair styling or retain the styling of the hair.

FIG. 1 is a perspective view illustrating a conventional hair brush.

As shown in FIG. 1, a conventional hair brush 1 includes a handle 4 formed on one side of the hair brush 1 and a body 2, wherein a plurality of teeth 3 are formed on an outer surface of the body 2.

The conventional hair brush 1 is used to apply warm or hot air to dry an individual's hair to dry the hair or perform the hair styling.

However, in the conventional hair brush, the warm or hot hair is provided to an outer layer of hair only so that not all portions of the hair can be evenly dried.

SUMMARY OF THE INVENTION

The present invention has been made in view of the above problems, and it is an objective of the present invention to provide a hair brush for hot curling in which tangling of hair and hair loss, which can be caused by static electricity during drying or curling the hair, may be prevented by providing a connection member formed in silicon or carbon in at least one position of a body of the hair brush that is made of aluminum.

In accordance with an aspect of the present invention, a hair brush for hot curling includes: a body configured to be formed by using a ceramic coated aluminum, which has a higher thermal conductivity, so that a hair can be dried quickly and evenly by conveying a heat inwardly and outwardly as well as in left and right sides of the body, wherein a plurality of holes are formed on a surface of the body to allow a steel teeth of a brush part to protrude therethrough, and wherein the body is segmented in either upper and lower portions or in further subportions; a closing cap configured to engage with the body that is formed by assembling the upper and lower portions or the further subportions of the body, wherein the closing cap is fitted into one end of the body; a connection member configured to connect the upper and lower portions or the further subportions of the body, wherein the connection member has a body part and an insertion groove to which the body is inserted, the insertion groove being positioned in a central area of the connection member, the body part having an "I" shape and including upper and lower portions, each of which has a semi-circle shape; and the brush part configured to allow a user to brush the hair while styling the hair, wherein the brush part includes a handle part having a predetermined length and a fastening part positioned at one end of the handle part, a cross section surface of the fastening part increases toward a first end of the fastening part that engages with and fastens to the assembled body, and wherein one end of an iron core, which is formed by twisting two or more wires, is securely engaged within the fastening part and a plurality of the steel teeth being formed on the iron core in a circumferential direction thereof so that a user can brush the hair while styling the hair by using the steel teeth.

In one example embodiment, the body may be formed in one body to be attached to an outer surface of an existing hair brush and fastened thereto, a plurality of grooves being formed on an outer surface of the body so that the connection member is pressed thereinto, wherein the plurality of the grooves are configured to have same or different lengths while being spaced apart from one another.

In one example embodiment, the connection member may be formed in a carbon or a silicon so that a static electricity generated during brushing the hair is suppressed, thereby preventing the hair from being tangled and avoiding hair loss occurring from a tangled hair, and wherein the connection member assists in styling by serving as a straightening/curling iron or pulling the hair to be straightened smoothly.

In one example embodiment, a teeth may be formed on the connection member so that, when styling a hair, the heat can be conveyed into an inner layer of the hair as well as preventing a static electricity from occurring, thereby avoiding hair damage, the teeth formed on the connection member is arranged to form at least one of an array of a pillar-shaped teeth, a fan-shaped array of lines of the pillar-shaped teeth, two arrays of the pillar-shaped teeth, each teeth in a first array having a different height from the teeth in a second array, or an array of zigzagged ribs that are connected one another at one end.

In one example embodiment, a plurality of grooves may be formed on the connection member so that the hair is combed along the grooves, thereby preventing the hair from being tangled.

BRIEF DESCRIPTION OF THE DRAWINGS

The objects, features and advantages of the present invention will be more apparent from the following detailed description in conjunction with the accompanying drawings, in which.

DETAILED DESCRIPTION OF EXEMPLARY EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein. Accordingly, example embodiments are to cover all modifications, equivalents, and alternatives falling within the scope of the invention.

Figure 2:
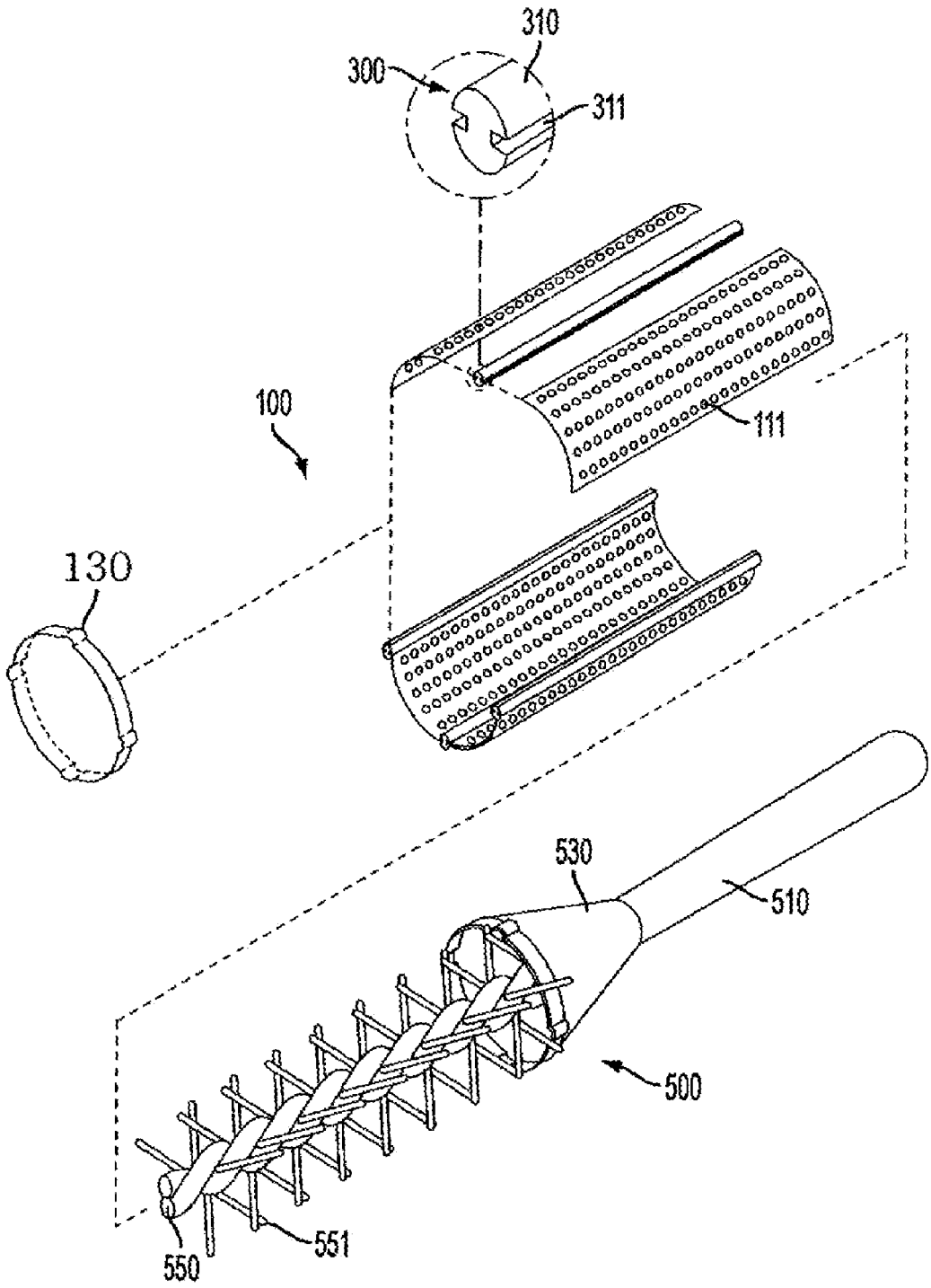
FIG. 2 is an exploded perspective view illustrating a hair brush according to one example embodiment of the present invention.
Figure 3:
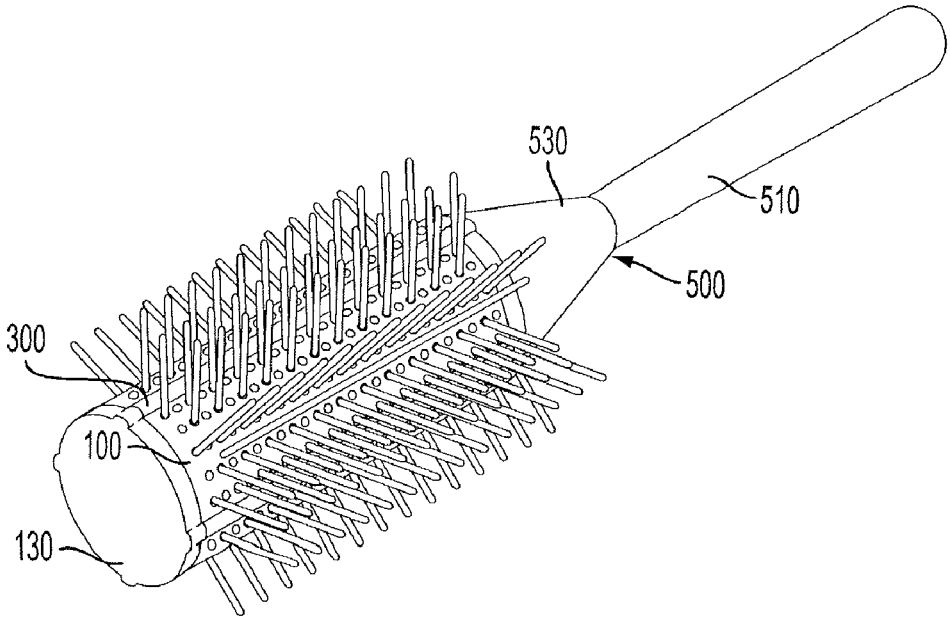
FIG. 3 is an assembled perspective view illustrating a hair brush according to one example embodiment of the present invention.

FIG. 2 is an exploded perspective view illustrating a hair brush according to one example embodiment of the present invention, FIG. 3 is an assembled perspective view illustrating a hair brush according to one example embodiment of the present invention and FIGS. 4A through 6B are perspective views illustrating a hair brush or a part of the hair brush according to various example embodiments of the present invention.

The hair brush of the present invention includes a body 100, a connection member 300 for connecting parts of the body 100 and a brush part 500.

The body 100 is formed by using a ceramic coated aluminum, which has a higher thermal conductivity, so that a hair can be dried quickly and evenly by conveying heat inwardly and outwardly as well as in left and right sides of the body 100.

Figure 1:
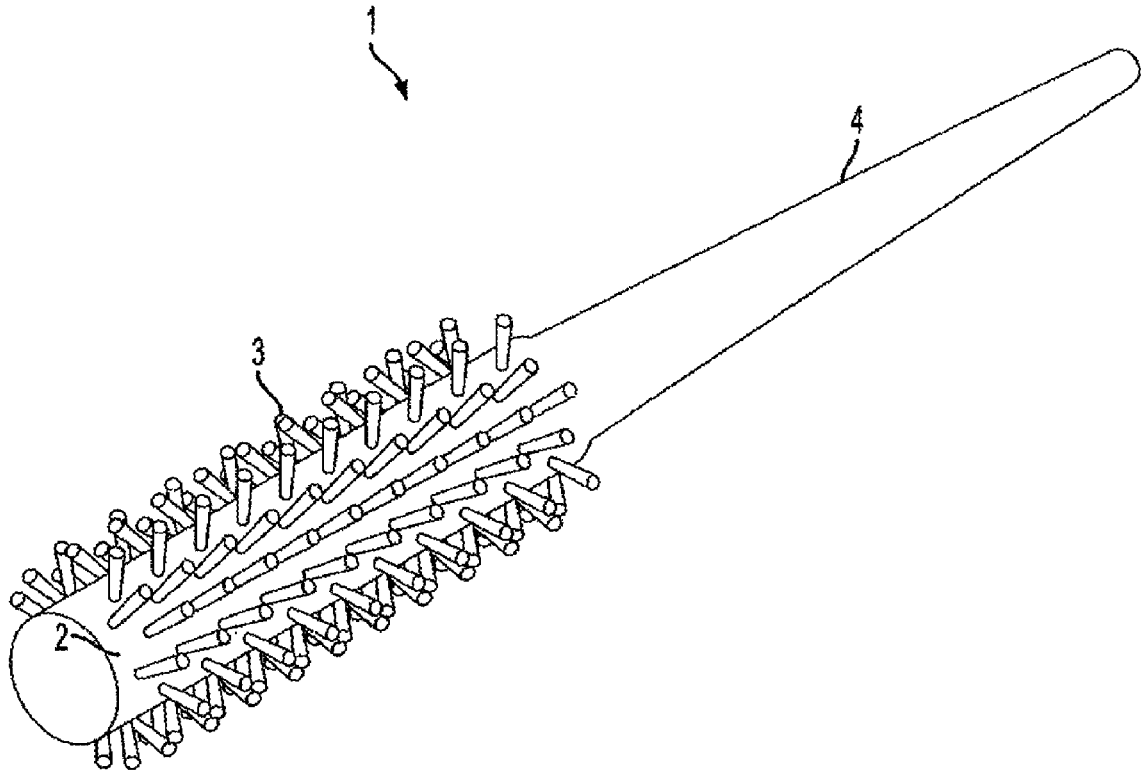
FIG. 1 PRIOR ART
FIG. 1 is a perspective view illustrating a conventional hair brush.

Also, a plurality of holes 111 are formed on a surface of the body 100 to allow a steel teeth 551 of the brush part 500 to protrude therethrough. The brush part 500 will further be described in more detail below. The body 100 can be segmented in upper and lower portions as illustrated in FIG. 1. It should be noted that the body 100 can be further segmented in various sub-components. Further, the body 100 can be configured to have a circular, polygonal or any other shape.

The respective segments of the body 100 are assembled, wherein one end of the assembled body 100 is engaged with a closing cap 130 and fastened thereto.

Figure 4A:
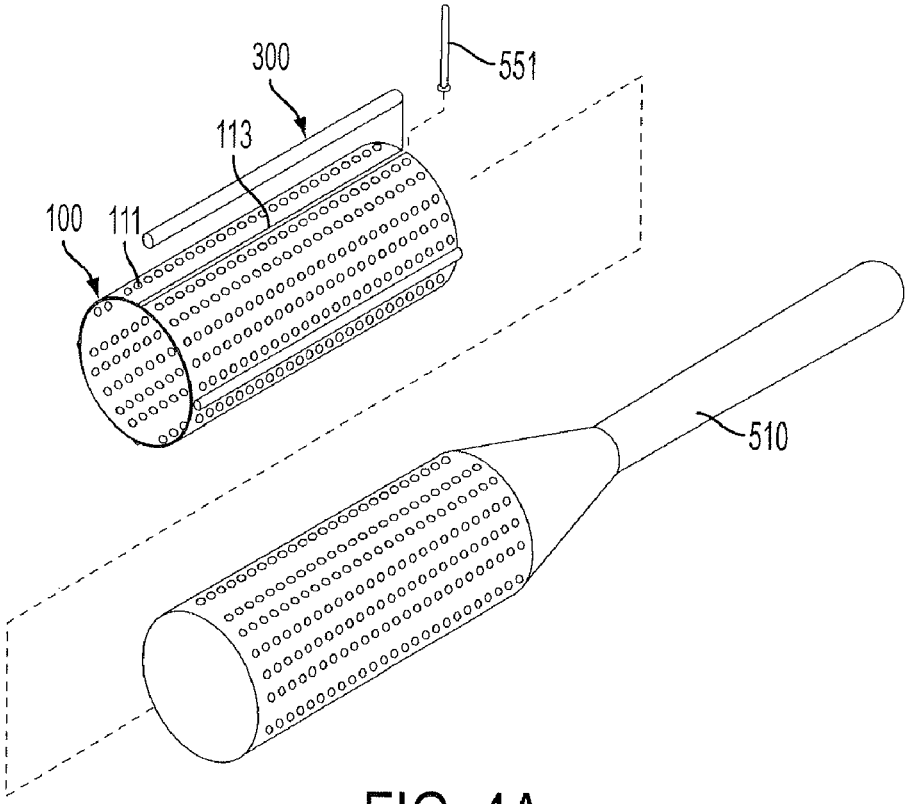
FIGS. 4A through 6B are perspective views illustrating a hair brush or a part of the hair brush according to various example embodiments of the present invention.

The body 100 can be provided in one body as illustrated in FIG. 4A. In this case, the body 100 can be utilized such that the body 100 is attached to an existing hair brush and fastened thereto. In order to fasten the body 100 to the hair brush, a plurality of grooves 113 can be formed on an outer surface of the body 100 so that the connection member 300 may be pressed thereinto. The connection member 300 will be further discussed below in more detail.

Figure 4B:
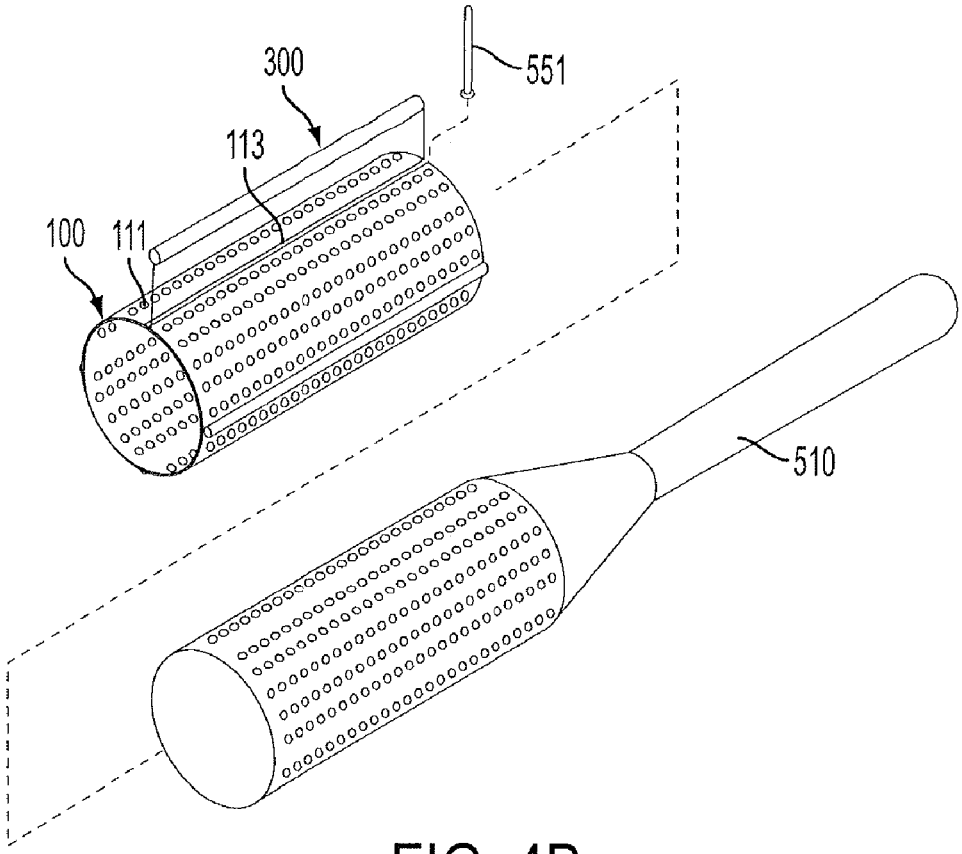

The groove 113 may be formed to have a different length. Also, the groove 113 may be positioned in different locations of the body 100, an example of which is illustrated in FIG. 4B.

The connection member 300 is used to connect the respective segments of the body 100. The connection member 300 has a body part 310 and an insertion hole 311 to which the body 100 of the brush is inserted. The body part 310 may have an "I" shape. Namely, the body party 310 of the connection member 300 includes upper and lower portions, each of which has a semi-circle shape.

The connection member 300 may be formed in carbon or silicon. When the connection member 300 is formed in carbon, static electricity generated during brushing the hair can be prevented because carbon suppresses the accumulation of static electricity. Accordingly, the hair can be prevented from being tangled so that hair loss caused by tangled hair can be avoided. Also, the hair brush with the connection member 300 made of carbon can be used to assist in styling by serving as a straightening/curling iron.

When the connection member 300 is formed in silicon, a predetermined tension is applied to the hair so the hair can be straightened smoothly by pulling the hair through the brush.

Figure 5A:
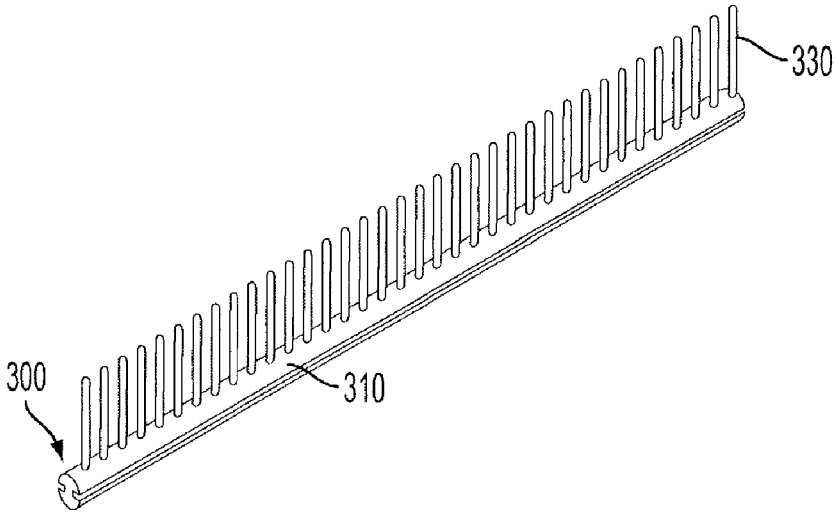
Figure 5B:
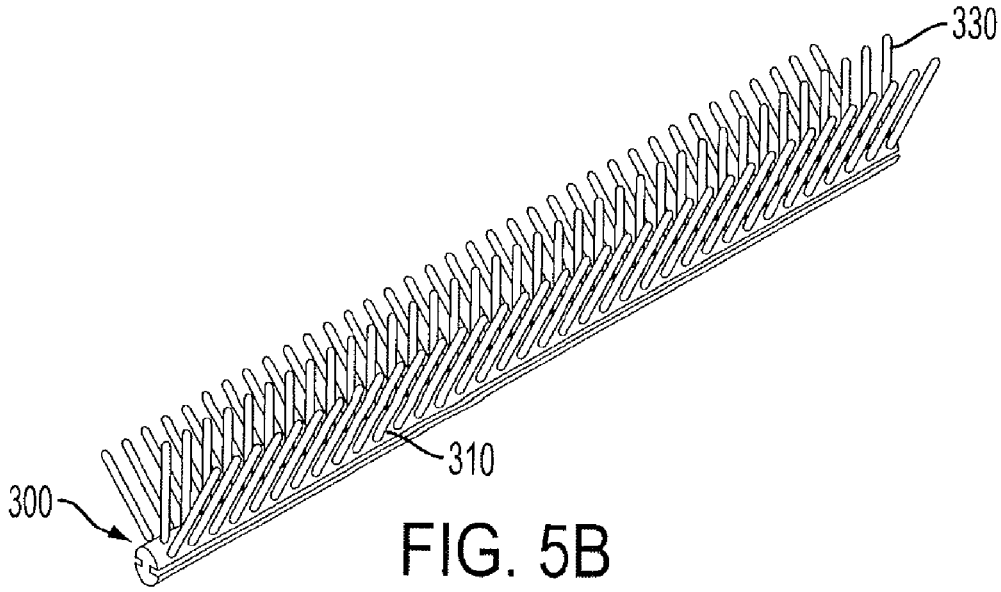
Figure 5C:
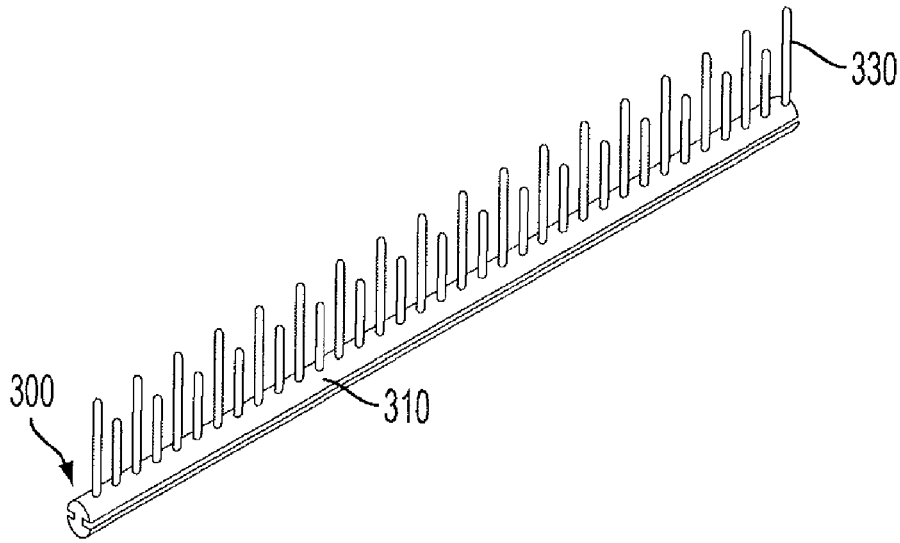
Figure 5D:
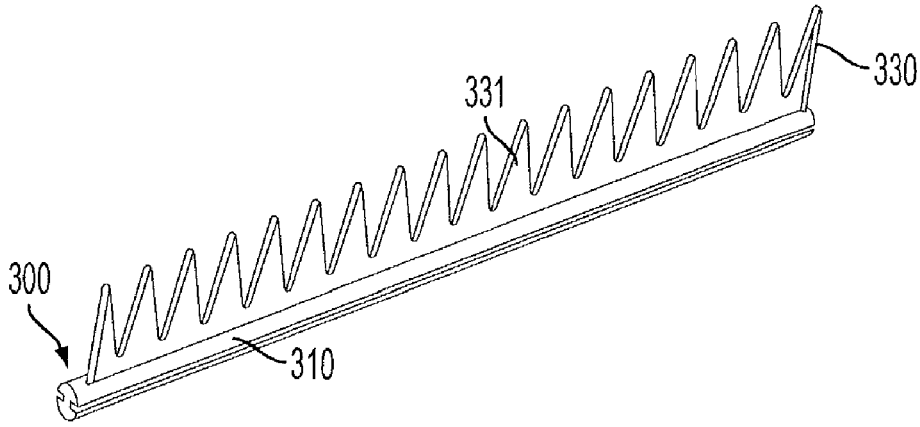

Referring to FIG. 5A, the connection member 300 includes a teeth 330 so that, when styling a hair, heat from the body 100 that is heated by a dryer can be conveyed deep into an inner layer of the hair.

Here, in FIG. 5A, the teeth 330, each of which is formed to have a pillar shape, are arranged in a row. Also, in FIG. 5B, the teeth 330 having a pillar shape is arranged such that a fan-shaped array of three lines is formed. Alternatively, in FIG. 5C, the teeth 330 can be arranged in two rows of pillars, wherein pillars in a first row have a different height from those in a second row. Further, in FIG. 5D, the teeth can be arranged in a structure such that the teeth 330 is formed in zigzagged ribs that are connected one another at one end.

Figure 6A:
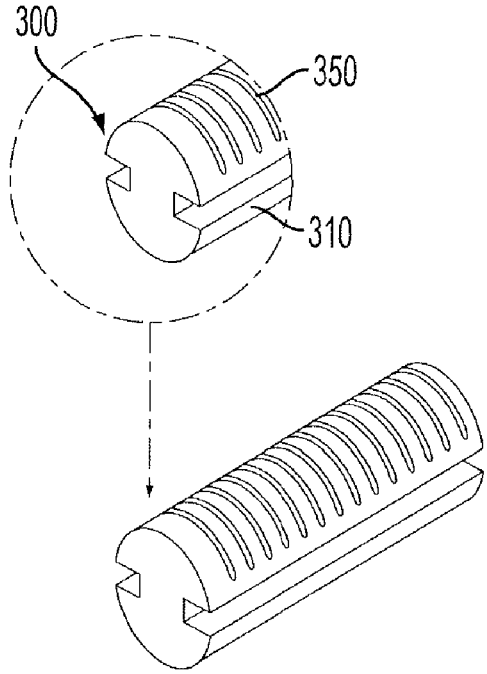
Figure 6B:
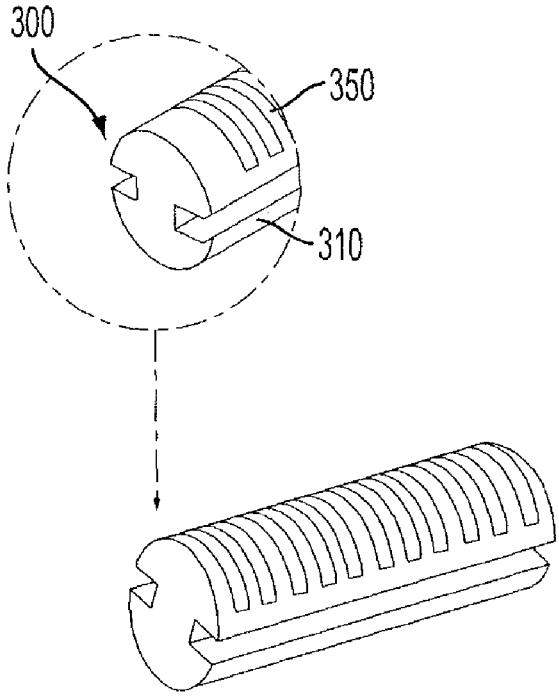

In addition, as shown in FIGS. 6A and 6B, a plurality of grooves 350 may be formed on the connection member 300 so that the hair can be combed along the grooves 350. In this way, hair tangles can be prevented.

Now referring back to FIG. 2, the brush part 500 is employed to allow a user to brush the hair while styling the hair. The brush part 500 includes a handle part 510 having a predetermined length and a fastening part 530 that is connected to one end of the handle part 510. The fastening part 530 is configured such that a cross section surface of the fastening part 530 increases toward a first end thereof, which connects with the body 100. The fastening part 530 is engaged with one end of the body 100 that is assembled and attached to the brush part 500.

Here, one end of an iron core 550, which is formed by twisting two or more wires, is securely engaged within the fastening part 530. A plurality of the steel teeth 551 are formed on the iron core 550 in a circumferential direction thereof so that a user can brush the hair while styling the hair by using the steel teeth 551.

Hereinafter, with reference to the drawings, an operation of the present invention is described.

In order to dry and style hair after washing the hair, a dryer (not shown) is used to blow hot air over the wet hair.

The hot air is conveyed to the body 100 that is made of aluminum so that the hair can be evenly dried from an inside out.

Also, the hot air is conveyed to the teeth 330 of the connection member 300 so that heat can be evenly distributed to both right and left sides of the body 100. Further, static electricity created during hair brushing may be prevented by using a teeth made of carbon or silicon, thereby preventing hair from being tangled. Consequently, tangled hair that normally leads to hair loss can be avoided.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

What is claimed is:

1. A hair brush for hot curling, the hair brush comprising:

a body configured to be formed by using a ceramic coated aluminum, which has a higher thermal conductivity, so that a hair can be dried quickly and evenly by conveying a heat inwardly and outwardly as well as in left and right sides of the body, wherein a plurality of holes are formed on a surface of the body to allow a steel teeth of a brush part to protrude therethrough, and wherein the body is segmented in either upper and lower portions or in further subportions;

a closing cap configured to engage with the body that is formed by assembling the upper and lower portions or the further subportions of the body, wherein the closing cap is fitted into one end of the body;

a connection member configured to connect the upper and lower portions or the further subportions of the body, wherein the connection member has a body part and an insertion groove to which the body is inserted, the insertion groove being positioned in a central area of the connection member, the body part having an "I" shape and including upper and lower portions, each of which has a semi-circle shape; and the brush part configured to allow a user to brush the hair while styling the hair, wherein the brush part includes a handle part having a predetermined length and a fastening part positioned at one end of the handle part, a cross section surface of the fastening part increases toward a first end of the fastening part that engages with and fastens to the assembled body, and wherein one end of an iron core, which is formed by twisting two or more wires, is securely engaged within the fastening part and a plurality of the steel teeth being formed on the iron core in a circumferential direction thereof so that a user can brush the hair while styling the hair by using the steel teeth.

2. The hair brush according to claim 1, wherein the body is formed in one body to be attached to an outer surface of an existing hair brush and fastened thereto, a plurality of grooves being formed on an outer surface of the body so that the connection member is pressed thereinto, wherein the plurality of the grooves are configured to have same or different lengths while being spaced apart from one another.

3. The hair brush according to claim 1, wherein the connection member is formed in a carbon or a silicon so that a static electricity generated during brushing the hair is suppressed, thereby preventing the hair from being tangled and avoiding hair loss occurring from a tangled hair, and wherein the connection member assists in styling by serving as a straightening/curling iron or pulling the hair to be straightened smoothly.

4. The hair brush according to claim 1, wherein a teeth is formed on the connection member so that, when styling a hair, the heat can be conveyed into an inner layer of the hair as well as preventing a static electricity from occurring, thereby avoiding hair damage, and wherein the teeth formed on the connection member is arranged to form at least one of an array of a pillar-shaped teeth, a fan-shaped array of lines of the pillar-shaped teeth, two arrays of the pillar-shaped teeth, each teeth in a first array having a different height from the teeth in a second array, or an array of zigzagged ribs that are connected one another at one end.

5. The hair brush according to claim 2, wherein a teeth is formed on the connection member so that, when styling a hair, the heat can be conveyed into an inner layer of the hair as well as preventing a static electricity from occurring, thereby avoiding hair damage, the teeth formed on the connection member is arranged to form at least one of an array of a pillar-shaped teeth, a fan-shaped array of lines of the pillar-shaped teeth, two arrays of the pillar-shaped teeth, each teeth in a first array having a different height from the teeth in a second array, or an array of zigzagged ribs that are connected one another at one end.

6. The hair brush according to claim 1, wherein a plurality of grooves are formed on the connection member so that the hair is combed along the grooves, thereby preventing the hair from being tangled.

7. The hair brush according to claim 2, wherein a plurality of grooves are formed on the connection member so that the hair is combed along the grooves, thereby preventing the hair from being tangled.

* * * * *